United States Patent [19]

Hayashi et al.

[11] 4,091,908

[45] May 30, 1978

[54] COIN CHECKING DEVICE FOR A VENDING MACHINE

[75] Inventors: Yukichi Hayashi; Masayuki Tamura; Osamu Sugimoto, all of Sakado; Shinichi Kobayashi, Kamifukuoka; Masanori Tanaka, Sakado, all of Japan

[73] Assignee: Nippon Coinco Co., Ltd., Tokyo, Japan

[21] Appl. No.: 765,565

[22] Filed: Feb. 4, 1977

[30] Foreign Application Priority Data

Feb. 10, 1976 Japan ..... 51-13719

[51] Int. Cl.[2] ..... G07F 3/02

[52] U.S. Cl. ..... 194/100 A

[58] Field of Search ..... 194/97 R, 100 R, 100 A; 73/163; 209/81 R, 81 A

[56] References Cited

U.S. PATENT DOCUMENTS

| | | | |
|---|---|---|---|
| 2,540,063 | 1/1951 | Victoreen | 194/100 A |
| 3,901,368 | 8/1975 | Klinger | 194/100 A |
| 3,918,563 | 11/1975 | Schwippert et al. | 194/100 A |
| 3,933,232 | 1/1976 | Searle et al. | 194/100 A |

*Primary Examiner*—Robert B. Reeves
*Assistant Examiner*—Joseph J. Rolla
*Attorney, Agent, or Firm*—Ladas, Parry, Von Gehr, Goldsmith & Deschamps

[57] ABSTRACT

A coin checking device for a vending machine capable of electrically examining whether an inserted coin is a true coin or a counterfeit one as well as kind of the coin. The device detects a waveform representing passage of the coin and also whether the peak level of the waveform appears in a predetermined window or not and, if the peak level is detected in the window, judges that the inserted coin is a true one.

4 Claims, 5 Drawing Figures

6
10
1
F1
2
3
4
5
F2
11
A
7
8
9
12
C1
13
C2
14
H
15
L
16
H
17
L
18
S
R
F/F
Q
19
22
S
R
F/F
Q̄
23
24
20
21
27
28
28-1
28-2
28-3
28-4
25
26
29
31
R'
R
30
32
33
35
34
36

COIN CHECKING DEVICE FOR A VENDING MACHINE

BACKGROUND OF THE INVENTION

This invention relates to a coin checking device for a vending machine.

In the conventional vending machine, checking of money including inserted coins of various denominations is sometimes erroneous particularly when the coins of a variety of kinds are simultaneously inserted in the machine because the inserted coins of various denominations are not accurately judged due to the similarity of the detection waveshapes of the inserted coins of different denominations. In additions a turbulence tends to occur among the detection waveshapes of the coins of various denominations sequentially inserted in the machine.

SUMMARY OF THE INVENTION

It is, therefore, an object of this invention to provide a coin checking device for a vending machine which has eliminated the above described disadvantages of the prior art vending machine.

It is another object of the invention to provide a coin checking device for a vending machine capable of accurately judging the inserted coins therein whether they are true or false and the kind of the coins by way of the peak level of the detection waveshape of the inserted coin by a coin detector.

It is another object of the invention to provide a coin checking device for a vending machine incorporating one or more window circuits which may judge the kind of the inserted coins in the machine depending upon the peak levels of the inserted coin detection waveshapes detected by a coin detector of electronic type.

BRIEF DESCRIPTION OF THE DRAWINGS

Other objects and features of the invention will become apparent from the description made hereinbelow with reference to the coompanying drawings in which.

DESCRIPTION OF THE PREFERRED EMBODIMENTS

A coin detector employed in the coin checking device for a vending machine of this invention is of a differential transformer type consisting of a primary winding coil 1 excited by a predetermined frequency F and two secondary winding coils 2 and 3 connected in opposite phase series manner. Such coin detectors 10 and 11 of differential transformer type are sequentially arranged along a coin path (not shown) in the passing direction of a coin 6 to be inserted in the machine as designated by an arrow A in FIG. 1.

Figure 2:
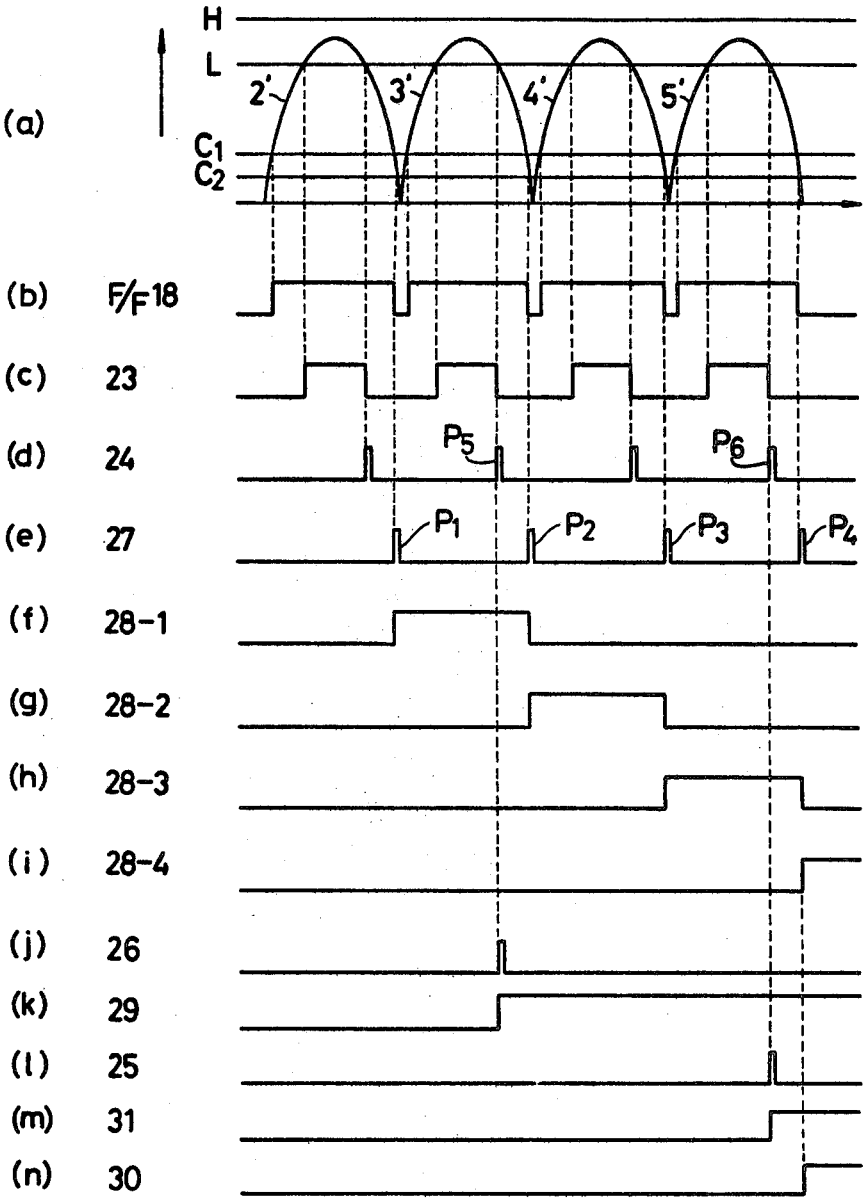
FIG. 2 is a time chart illustrative of signals appearing at various parts in the block circuit shown in FIG. 1.

The detected outputs from the secondary coils 2 and 3 of the coin detector 10 are respectively applied to an amplifier 7, and the detected outputs from the secondary coils 4 and 5 of the coin detector 11 are applied to an amplifier 8. Then, the outputs from the amplifiers 7 and 8 are mixed together and provided on a line 9. Accordingly, the secondary winding coils 2, 3 and 4, 5 of the respective coin detectors 10 and 11 respectively produce sequentially inserted coin detection waveshapes 2', 3', 4' and 5' of substantially crest shape in response to the inserted coin 6 passing through the detectors 10 and 11 in the coin path (not shown) on the line 9 in mixture in the order as listed above, as shown in FIG. 2(*a*). These detection waveshapes 2' through 5' on the line 9 are respectively applied to the inputs of level detectors 12, 13, 14, 15, 16, 17, . . . in which these waveshapes 2' through 5' are compared with respective set levels preset in the respective detectors 12 through 17.

The level detectors 12 and 13 are adapted to detect the passage of the inserted coin and have each a set level provided in the vicinity of the valley or bottom of the detection waveshapes 2' through 5'. The set level $C_1$ of the level detector 12 is preferably higher in small amount than the set level $C_2$ of the level detector 13 as shown in FIG. 2(*a*). Further, the level detectors 12 through 17 produce a signal "1" when the level of the coin detection waveshape applied to the inputs thereof is higher than the set level. Thus, if the levels of the detection waveshapes 2' through 5' become higher than the set level $C_1$ therein, the level detector 12 produces an output signal "1", which is applied to the set input of a flip-flop 18 to set the flip-flop 18.

When the levels of the detection waveshapes 2' through 5' become lower than the set level $C_2$ of the coin detector 13, output of the level detector 13 changes from "1" to "0". Thus, the output signal from the level detector 13 is then inverted by an inverter 19 and the inverted output "1" is applied to the reset input of the flip-flop 18 to cause the flip-flop 18 to be reset. Thus, the flip-flop 18 produces a pulse output having a pulse width substantially corresponding to the waveshape width or time duration in the vicinity of the valley or bottom of the coin detection waveshapes 2' through 5' in response to the passage of the inserted coin therethrough as shown in FIG. 2(*b*). Therefore, when the flip-flop 18 is producing its output pulse, it means that the inserted coin is passing through the secondary coils 2, 3 and 4, 5 of the respective coin detectors 10 and 11, respectively which detectors are producing the coin detection waveshapes 2', 3' and 4', 5' of peaking crest shape.

Since there are provided a difference between the set level $C_1$ and the set level $C_2$, there are advantageously provided a hysteresis characteristic between the setting and resetting operations of the flip-flop 18 thereby. Accordingly, even if there occurs turbulence of the detection waveshapes 2' through 5' produced from the coin detectors 10 and 11, the flip-flop 18 will accurately produce only one shot of the output pulse upon receipt of one detection waveshape. On the other hand, in case the flip-flop 18 is set and reset by only one level, the setting and resetting operations are frequently repeated in the flip-flop 18 in the event that irregularity occurs in the detection waveshapes 2' through 5' so that these waveshapes fluctuate above and below the set level. As a result, a large number of pulses are produced. Therefore, it is advantageously very effective to set and reset the flip-flop 18 via the two levels $C_1$ and $C_2$ preset in the level detectors 12 and 13, respectively as in this embodiment so as to prevent the flip-flop 18 from producing fluctuated frequent pulses per one detection waveshape.

Level detectors 14, 15 and 16, 17 are preferably of the same construction and operation as those of the aforesaid level detectors 12 and 13 in combination as a pair except for judging or discriminating the upper and lower limit threshold levels preset in window circuits 20 and 21 for detecting the peak levels of the coin detection waveshapes produced from the coin detectors 10 and 11. For example, assume that the window circuit 20 is constructed to detect the peak level of a 10 yen coin detection waveshape, a set upper limit threshold level H (see FIG. 2(*a*)) preset in the level detector 14 is the upper limit value of the peak level of the 10 yen coin detection waveshape in the level detector 14, and a set lower limit threshold level L(see FIG. 2(*b*)) preset in the level detector 15 is the lower limit value of the peak level of the 10 yen coin detection waveshape in the level detector 15. In the meanwhile, assuming also that the window circuit 21 is constructed to detect the peak level of a 50 yen coin detection waveshape, a set upper limit threshold level H preset in the level detector 16 is the upper limit value of the peak level of the 50 yen coin detection waveshape in the level detector 16, and a set lower limit threshold level L preset in the level detector 17 is the lower limit value of the peak level of the 50 yen coin detection waveshape in the level detector 17.

It will be understood that the aforementioned windows circuit may also be provided in a variety of types depending upon the difference of functions such as for the detections of the inserted coins of various denominations and of the configurations of the inserted coins to be detected but particular description and disclosure thereof are omitted. It will also be appreciated that the set upper and lower limit threshold levels H and L of the respective level detectors 14, 16 and 15, 17 are different from each other in the respective window circuits 20 and 21 but other construction and arrangement and operation thereof are of the same and accordingly the description thereof will now be carried out with reference to only one window circuit 20.

The level detector 15 produces an output signal "1" when the levels of the coin detection waveshapes 2' through 5' become higher than the set lower limit threashold level L, which signal "1" sets a flip-flop 22. Thus, a reset output $\overline{Q}$ of the slip-flop 22 becomes "0", which is applied to one input of a NOR gate 23. The output of level detector 14 is "0" unless the levels of the coin detection waveshapes 2' through 5' does not become higher than higher limit threshold level H.. Thus the NOR gate 23 produces an output signal "1" as shown in FIG. 2(*c*) because both the inputs of the OR gate 23 receive the signal "0" from the flip-flop 22 and the level detector 14.

In case the levels of the coin detection waveshapes 2' through 5' become fallen lower than the set lower limit threshold level L, the flip-flop 22 is reset and a reset output $\overline{Q}$ rises from "0" to "1". Then the output of NOR gate 23, falls from "1" to "0" as shown in FIG. 2(*c*).

The waveshape trailing edge detection pulse generator 24 is constructed to detect the output of the NOR gate 23 falling from "1" to "0" at the trailing edge of the pulse produced from the NOR gate 23 and to produce a short pulse as shown in FIG. 2(*d*).

The pulse generator 24 may employ a circuit of known type having for example delay flip-flops $DF_1$ and $DF_2$ for delaying an input pulse thereto by one bit time by a clock pulse $\phi$, an inverter $IN_1$ and an AND gate $AN_1$.

Therefore, if the peak levels of the coin detection waveshapes 2' through 5' are produced between the upper and lower limit threshold levels H and L (within the window) the pulse generator 24 produces one short pulse upon receipt of one coin detection waveshape as shown in FIG. 2(*d*). The pulse from the pulse generator applied to one input of each of AND gates 25 and 26.

Figure 3:
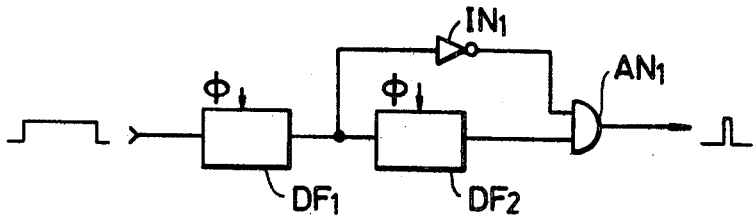
FIG. 3 is a block diagram showing one example of a waveshape trailing edge detection pulse generator to be employed in the circuit of the checking device of this invention.

In the meanwhile, the set output signal Q of the flip-flop 18 is applied to a waveshape trailing edge detection pulse generator 27 which produces one short pulse upon receipt of the output of the flip-flop 18. The pulse generator 27 may be a circuit of known type as was phereinabove described as shown in FIG. 3. Since the flip-flop 18 produces an output pulse having a pulse width substantially corrresponding to the width of the coin detection waveshapes 2' through 5' as shown in FIG. 2(*b*), the pulse generator 27 produces a short pulse at every trailing edge of the waveshapes falling from "1" to "0" as shown in FIG. 2(*e*). This trailing edge detection pulse is used as a shifting pulse of a shift register 28.

This shift register 28 is constructed to load a pulse signal "1" in the initial stage 28-1 thereof upon receipt of the initial pulse $P_1$ (see FIG. 2(*e*)) from the pulse generator 27 produced at substantially trailing edge of the first coin detection waveshape 2' produced from the output of the secondary coil 2 of the coin detector 10.

Then, when the second pulse $P_2$ produced from the pulse generator 27 at substantially trailing edge of the second coin detection waveshape 3' produced from the output of the secondary coil 3 of the coin detector 10 as was hereinabove described as shown in FIG. 2(*e*) is applied to the shift register 28, the signal "1" in the initial stage 28-1 of the shift register 28 is shifted to the second stage 28-2 thereof. Further, when the third pulse $P_3$ produced from the pulse generator 27 at substantially trailing edge of the third coin detection waveshape 4' produced from the output of the secondary coil 4 of the coin detector 11 is applied to the shift register 28, the signal "1" in the second stage 28-2 of the shift register 28 is shifted to the third stage 28-3 thereof. Similarly, the fourth pulse $P_4$ produced from the pulse generator 27 at substantially trailing edge of the fourth coin detection wave shape 5' produced from the output of the secondary coil 5 of the coin detector 11 shifts the signal "1" in the third stage 28-3 of the shift register 28 to the fourth stage 28-4 of the shift register 28. Thus, the outputs of the respective stages 28-1 to 28-4 of the shift register 28 become as designated in FIGS. 2(*f*) through 2(*i*).

As clear from the foregoing description, the initial stage 28-1 of the shift register 28 produces an output signal "1" at the timing substantially corresponding to the time duration or width of the second coin detection waveshape 3', the second stage 28-2 of the shift register 28 produces an output signal "1" at the timing substantially corresponding to the time duration or width of the third coin detection waveshape 4', and the third stage 28-3 of the shift register 28 produces an output signal "1" at the timing substantially corresponding to the time duration or width of the fourth coil detection waveshape 5'.

The output signal of the initial stage 28-1 of the shift register 28 is applied to the other input of the AND gate 26, and the output signal of the third stage 28-3 of the shift register 28 is applied to the other input of the AND gate 25. Accordingly, the AND gate 26 produces an output signal while the second coin detection waveshape 3' is produced from the output of the secondary coil 3 of the coin detector 10 as was heretofore described. If the peak level of the second coin detection waveshape 3' is between the set upper and lower limit threshold levels H and L preset in the window circuit 20, the pulse generator 24 produces an output pulse $P_5$ (see FIG. 2(*d*)) representing the inserted coin is true or correct. Then, the output pulse $P_5$ is applied to the other input of the AND gate 26 to cause the AND gate 26 to produce an output signal "1" as shown in FIG. 2(*j*), which is applied to a pulse counter 29.

The pulse counter 29 is constructed to produce a continuous output signal "1" upon receipt of only one pulse from the AND gate 26 but to reset the output signal "1" to "0" upon receipt of two or more pulses from the AND gate 26. In the example as shown in FIG. 2, since the pulse counter 29 receives only one pulse from the AND gate 26, the pulse counter 29 produces a continuous output signal "1" as shown in FIG. 2(*k*), which is applied to one input of an AND gate 30.

In the meanwhile, the output signal of the third stage 28-3 of the shift register 28 is applied to the other input of the AND gate 25. Accordingly, the AND gate 25 is in an operable condition while the fourth coin detection waveshape 5' is produced. If the peak level of the fourth coin detection waveshape 5' is between the set upper and lower limit threshold levels H and L preset in the window circuit 20, the pulse generator 24 produces an output pulse $P_6$ (see FIG. 2(*d*)), the AND gate 25 an output signal "1" as shown in FIG. 2(*l*) is applied to a pulse counter 31.

The pulse counter 31 is constructed in the same manner as the pulse counter 29 and is constructed to produce a continuous output signal "1" upon receipt of only one pulse from the AND gate 25, as shown in FIG. 2(*m*), which is applied to another input of an AND gate 30.

The output signal of the final stage 28-4 of the shift register 28 is applied to the other input of the AND gate 30. It the outputs of the pulse counters 29, 31 are both "1", this signifies that the peak levels of the coin detection waveshapes 3' and 5' are those of a true coin. Thus, the output "1" of the AND gate 30 is produced therefrom immediately after the final coin detection waveshape 5' falls from "1" to "0", i.e., the inserted coin 6 has passed the coin detectors 10 and 11 in the coin path (not shown). This output signal "1" from the AND gate 30 is a true coin detection signal expressing that the inserted coin 6 is detected to be correct as the true coin of the denomination such as 10 yen to be detected in the window circuit 20, and is applied to one input of an AND gate 32 as an inhibit circuit.

The inhibit circuit 32 is constructed to produce an output signal "1" under the condition that true coin detection signals of different denominations are not simultaneously produced to be described in detail later. More particularly, to the inhibit inputs of the inhibit circuit 32 are applied, for example, output signals "1" produced from AND gates 33 and 34 at the outputs of the window circuit 21 and the like circuits for checking 50 yen and 100 yen coins.

In case the true coin detection signals of different denominations are simultaneously produced from the AND gates 30, 33 and 34, this fact means the inserted coins are obviously false. Therefore, in this case the inhibit circuit 32, 35 and 36 will inhibit the AND gates 30, 33 and 36 to produce respective outputs.

In the meanwhile, in case the peak levels of the inserted coin detection waveshapes 2' through 5' become higher than the set upper limit threshold level H, the peak levels of the detection waveshapes 2' through 5' will again cross the upper limit threshold level H when the detection waveshapes 2' through 5' fall from above the level H to below the level H. Accordingly, when the detection waveshapes 2' through 5' become higher than the level H, an output of the NOR gate 23 falles from "1" to "0" and when the detection wave-shapes 2' through 5' fall from above the level H to below the level H, an output of the NOR gate 23 rises from "0" to "1", and when the detection waveshapes 2' through 5' further fall below the lower limit threshold level L, the NOR gate 23 produces an output falling again from "1" to "0". Accordingly, the pulse generator 24 produces thereupon two or more output pulses, which are applied to the pulse counter 29 or 31 via the AND gate 26 or 25 to cause the pulse counter 29 or 31 to be reset to produce an output "0", which is applied to the one input of the AND gate 30 to cause the AND gate 30 to produce no true coin detection signal. In the meanwhile, the aforesaid pulse counters 29, 31, 33 receive one reset signal R produced every time when the checking of the one inserted coin is completed.

Figure 1:
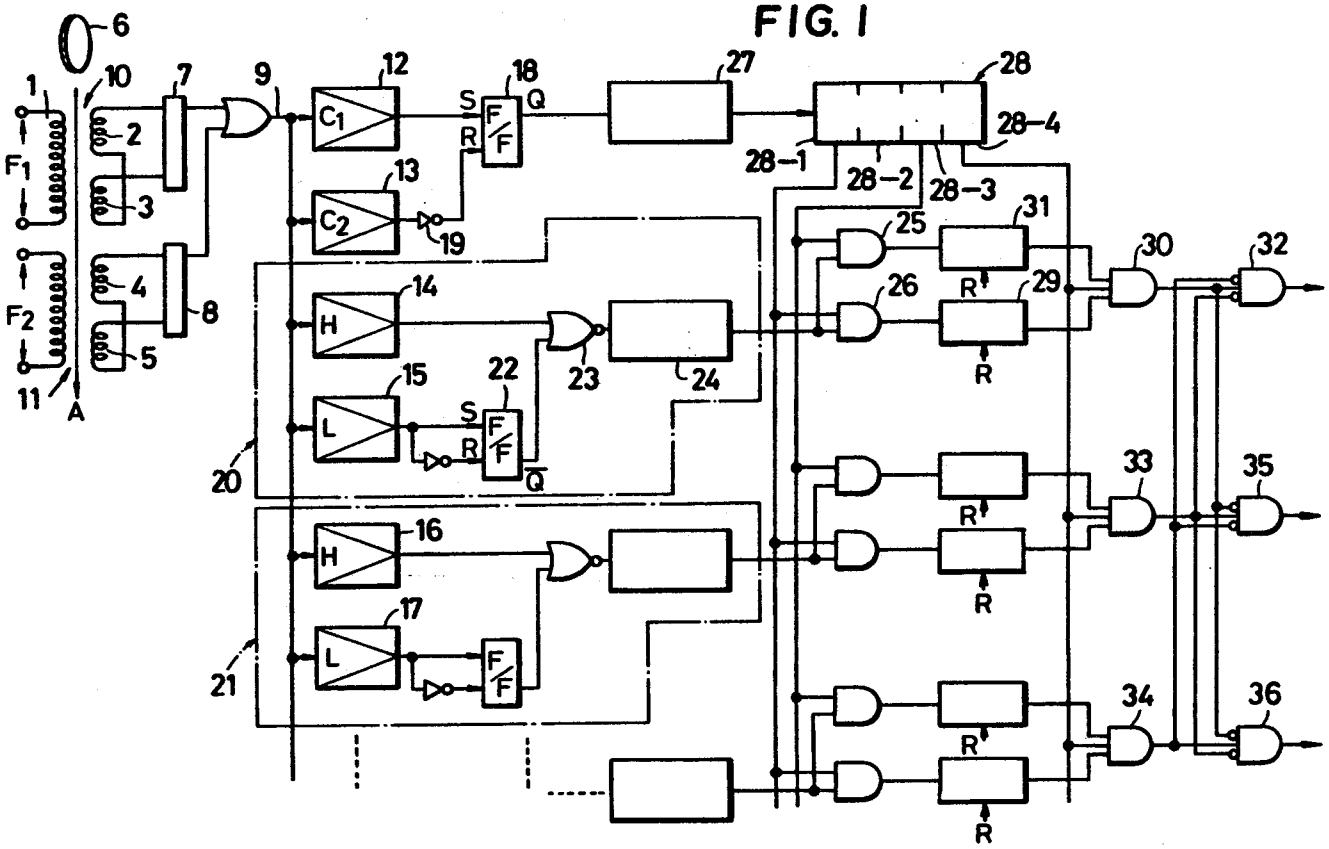
FIG. 1 is a block diagram schematically showing one preferred embodiment of the coin checking device for a vending machine according to this invention.

It is to be noted that although the outputs of the initial and third stages of the shift register 28 are respectively applied to the other inputs of the AND gates 26 and 25 to check the peak levels of the second and fourth inserted coin detection waveshapes 3' and 5' in the embodiment shown in FIG. 1 for convenience of description, the other detection waveshapes 2' and 4' may also be utilized in the same manner as above.

It should be appreciated that since the supply of exciting voltage to the primary winding coils of the coin detectors 10 and 11 is generally changed over in response to the passing of the inserted coin through the detectors, the stable detection waveshapes may be preferably produced from the secondary winding coils 3 or 5 rather than the secondary winding coils 2 or 4 first passing with the inserted coin. It should also be noted that two peak levels of the detection waveshapes are employed for checking the inserted coin for convenience accuracy.

The primary winding coils of the first and second coin detectors 10 and 11 are generally excited by different frequencies $F_1$ and $F_2$ to check the different characteristics of the coins inserted in the machine. For example, the first coin detector 10 may check the quality of material of the inserted coin and the second coin detector 11 may check the surface incuse pattern and shape of the inserted coin. Accordingly, in this case the inserted coin detection waveshapes 2' and 3' represent the detected results of the quality of material of the inserted coin and the detection waveshapes 4' and 5' illustrate the detected results of the surface incuse pattern and shape of the inserted coin in such a manner that the judging timings of the detection waveshapes are controlled by the shift register 28 to check both the characteristics of the inserted coin to cause the checking device to produce a true coin detection signal therefrom when both characteristics are detected to be correct resulting in high accuracy. It will be understood that it may be easy to normalize the inserted coin detection waveshapes of various denominations in the samplifiers 7 and 8 in correspondence to the level detectors 12 through 17.

Figure 4:
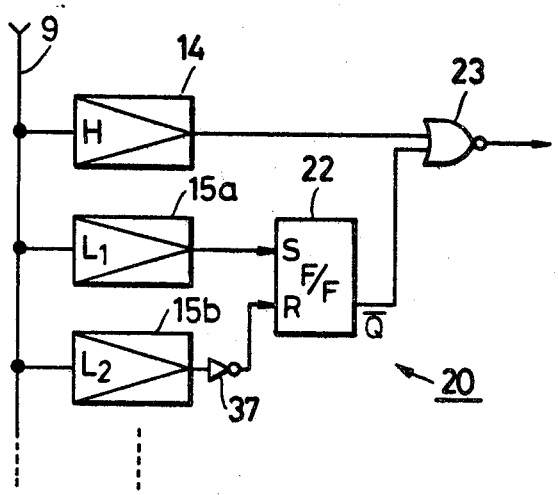
FIG. 4 is a block diagram partly showing another example of a window circuit shown in FIG. 1.

FIG. 4 shows another preferred example of the window circuit 20 having a hysteresis characteristic for the lower limit threshold level L in the window circuit 20 by providing two lower limit threshold levels $L_1$ and $L_2$.

Figure 5:
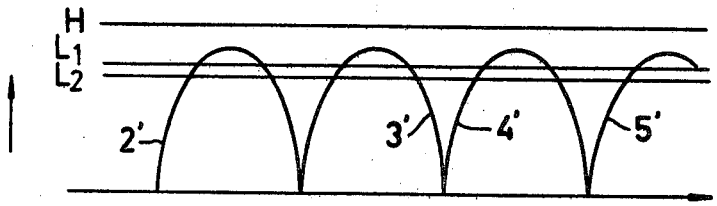
FIG. 5 is a time chart showing the relationship between the inserted coin detection waveshapes and the upper and lower limit set levels for the explanatory purpose of the operation of the window circuit shown in FIG. 4.

The window circuit 20 of this example has a level detector 15*a* having a first lower limit threshold level $L_1$ and a level detector 15*b* having a second lower limit threshold level $L_2$ which is somewhat lower than the threshold level $L_1$ as shown in FIG. 5. This circuit 20 is constructed to produce an output signal "1" when the inserted coin detection waveshapes 2' through 5' on the line 9 become higher than the set lower limit threshold levels $L_1$ and $L_2$. The output of the detector 15*a* is applied to the set input of the flip-flop 22, and the output of the level detector 15*b* is applied to the reset input of the flip-flop 22 via an inverter 37. Therefore, the flip-flop 22 is set by the output of the detector 15*a* when the peak levels of the detection waveshapes 2' through 5' become higher than the first lower limit threshold level $L_1$ and is then reset by the output of the detector 15*b* when the peak levels of the detection waveshapes 2' through 5' become lower than the second lower limit threshold level $L_2$. Accordingly, even if the peaking waveforms of the inserted coin detection waveshapes 2' through 5' frequently fluctuate up and down in the vicinity of the lower limit threshold level $L_1$ or $L_2$ in unstable state, the flip-flop 22 stably produces one shot of pulse upon detection of the coin detection waveshape of the inserted coin, from the NOR gate 23 in accurate manner.

It should be understood from the foregoing description that since the coin checking device for a vending machine of this invention is constructed to detect the passage of the inserted coin in the machine through the coin detectors with the pulse having a pulse width substantially corresponding to the time duration or width of the inserted coin detection waveshapes to check the peak levels of the detection waveshapes at the timing of this pulse, the checking device may check the inserted coins accurately. It should also be understood that the checking device of this invention has an advantage to check only the peak level of desired coin detection waveshapes in case of plural coin detection waveshapes inclusive therein. It should be appreciated that since the checking device of this invention is constructed to have a hysteresis characteristic in the detection of the peak levels of the inserted coin detection waveshapes detected by the coin detectors to eliminate the affection of the disorder of the coin detection waveshapes so as to check the inserted coin in accurate manner.

What is claimed is:

1. A coin checking device for a vending machine comprising:

a plurality of electronic type coin detectors each producing a detection waveshape of substantially crest shape in response to the passage of an inserted coin in the machine, coin identifying means for producing a pulse having a pulse width substantially corresponding to the time duration or width in the vicinity of the bottom of each detection waveshape produced from said coin detectors, window means for judging the peak level of each detection waveshape in correspondence to the inserted coin of a predetermined denomination; and output means for producing a true coin detection signal when the peak level of a true inserted coin is detected in said window means while said identifying means is producing said pulse produced from said checking means.

2. A coin checking device as defined in claim 1, wherein said identifying means comprises two set different levels preset in the vicinity of the bottom of said detection waveshapes, comparing means for comparing the level of each detection waveshape with the set levels, and a flip-flop set by the output of said comparing means when the level of a detection waveshape is higher than the set level and reset by the output of said comparing means when the level of the detection waveshape is lower than the set level.

3. A coin checking device as defined in claim 1, wherein said coin detector comprises at least two coin detectors of differential transformer type, the coin detection waveshapes of the respective secondary winding coils of the respective detectors are supplied to said coin identifying means and window means, said coin identifying means comprises means for forming a pulse having a pulse width substantially corresponding to the time duration in the vicinity of the bottom of each detection waveshape of said respective secondary winding coils and a shift register for sequentially shifting single signal "1" in the stages at a timing of pulses formed by said means for forming a pulse to produce a pulse substantially corresponding to the time duration of each respective detection waveshape from the respective stages of said shift register, and said output means is adapted to detect a true inserted coin based on an output pulse of said desired stage of said shift register and the judged result of the peak level in said window means by checking the peak level of the detection waveshape of a desired one of said respective secondary winding coils corresponding to the desired stages of said shift register.

4. A coil checking device as defined in claim 1, wherein said window means comprises a level for setting the upper limit of said window and a first lower limit set level for setting the lower limit of said window and a second lower limit set level slightly lower than the first lower limit level, said first lower limit level being used as the lower limit of said window when the level of a detection waveshape rises and said second lower limit level being used as the lower limit of said window when said detection waveshape falls.

* * * * *